US010167685B2

(12) United States Patent
Schober et al.

(10) Patent No.: US 10,167,685 B2
(45) Date of Patent: Jan. 1, 2019

(54) MACHINE AND METHOD FOR EARTH-WORKING

(71) Applicant: BAUER Maschinen GmbH, Schrobenhausen (DE)

(72) Inventors: Andreas Schober, Wertingen (DE); Christian Fischer, Kissing (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 15/462,092

(22) Filed: Mar. 17, 2017

(65) Prior Publication Data

US 2017/0284162 A1 Oct. 5, 2017

(30) Foreign Application Priority Data

Apr. 4, 2016 (EP) ..... 16163646

(51) Int. Cl.
*E21B 19/00* (2006.01)
*E21B 7/02* (2006.01)
(Continued)

(52) U.S. Cl.
CPC ..... *E21B 19/008* (2013.01); *E02D 5/34* (2013.01); *E02D 5/38* (2013.01); *E02D 7/22* (2013.01);
(Continued)

(58) Field of Classification Search
CPC ... E21B 3/02; E21B 7/02; E21B 15/00; E21B 17/07
See application file for complete search history.

(56) References Cited

U.S. PATENT DOCUMENTS 3,525,404 A * 8/1970 Newman et al. ..... E21B 19/08 173/150
4,137,974 A * 2/1979 Decker ..... E21B 3/04 173/147
(Continued)

FOREIGN PATENT DOCUMENTS

EP 1 655 415 A1 5/2006
EP 2 048 321 A1 4/2009

OTHER PUBLICATIONS

European Search Report issued by the European Patent Office dated Jun. 13, 2016, which corresponds to European Patent Application No. 16 163 646.9 and is related to U.S. Appl. No. 15/462,092.

*Primary Examiner* — D. Andrews
*Assistant Examiner* — Ronald R Runyan
(74) *Attorney, Agent, or Firm* — Studebaker & Brackett PC

(57) ABSTRACT

A machine and a method for earth-working with a machine, having a mast, along which a top drive can be moved vertically by an adjusting device, through which top drive a telescopic kelly bar is displaceably guided, which has at least one outer kelly bar, which is designed to come to lie on the top drive, and one inner kelly bar, which comprises a rope suspension for a rope, through which the inner kelly bar is moved vertically by a rope winch. The adjusting device for the top drive and/or the main rope winch for the kelly bar is/are automatically controlled, wherein the inner kelly bar is moved relative to the top drive in some areas in a rapid travel mode at a first speed and in some areas in a conservative travel mode, in which the speed is reduced in comparison with the first speed.

14 Claims, 2 Drawing Sheets

Figure 1:
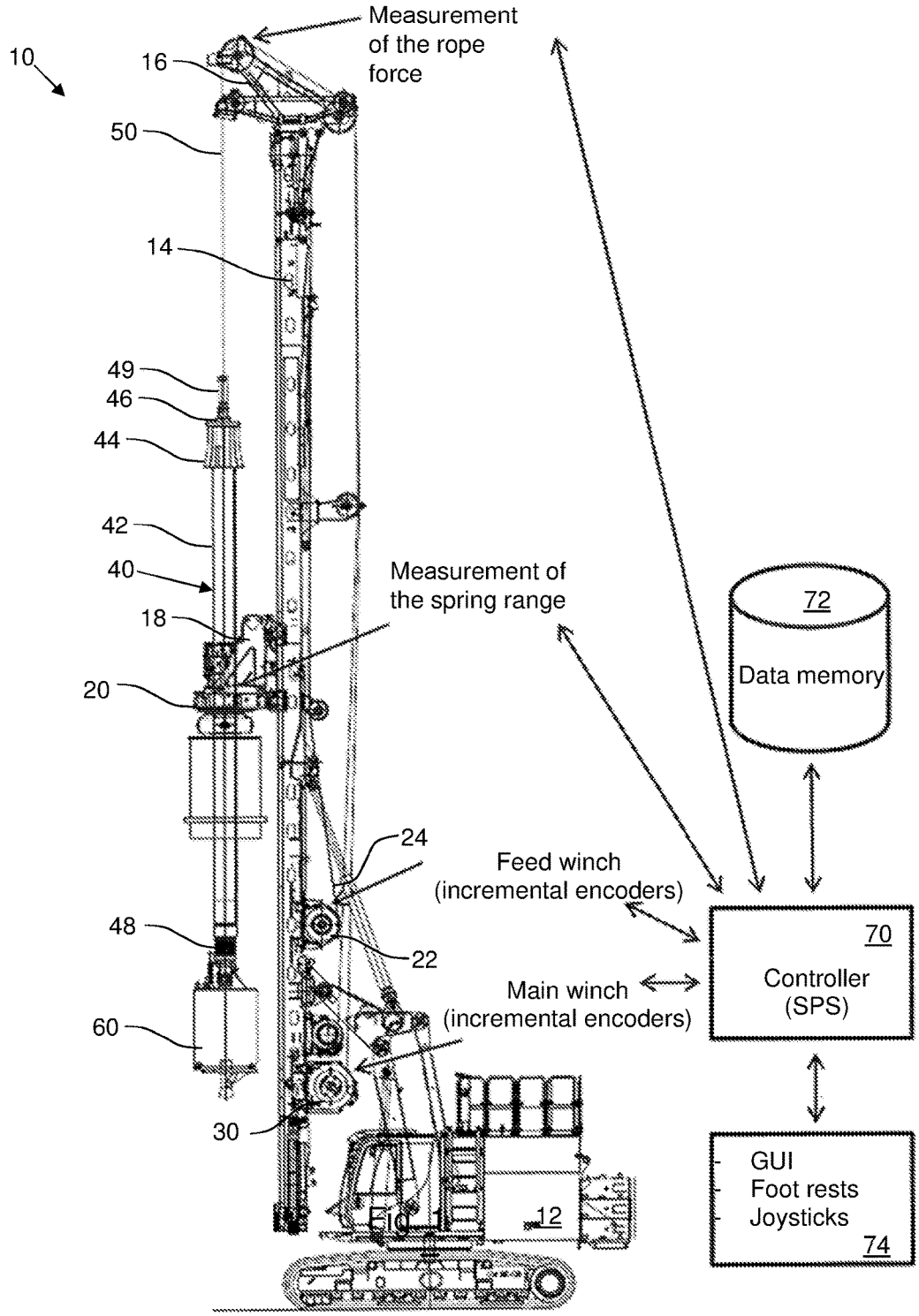

(51) Int. Cl.

| | |
|---|---|
| ***E21B 17/07*** | (2006.01) |
| ***E21B 15/00*** | (2006.01) |
| ***E02D 5/34*** | (2006.01) |
| ***E02D 5/38*** | (2006.01) |
| ***E02D 7/22*** | (2006.01) |
| ***E02D 11/00*** | (2006.01) |
| *E21B 27/00* | (2006.01) |

(52) U.S. Cl.
CPC ..... *E02D 11/00* (2013.01); *E21B 7/02* (2013.01); *E21B 15/00* (2013.01); *E21B 17/07* (2013.01); *E21B 27/00* (2013.01)

(56) References Cited

U.S. PATENT DOCUMENTS

| | | | | |
|---|---|---|---|---|
| 4,339,946 | A * | 7/1982 | Cole | E21B 47/04 173/21 |
| 4,722,389 | A * | 2/1988 | Arnold | E21B 33/05 166/285 |
| 5,167,400 | A * | 12/1992 | Gazel-Anthoine | B66B 1/28 254/275 |
| 5,746,277 | A * | 5/1998 | Howell, Jr. | E21B 3/04 173/147 |
| 2006/0096941 | A1 | 5/2006 | Stoetzer | |
| 2009/0071674 | A1 | 3/2009 | Saehn et al. | |

* cited by examiner

MACHINE AND METHOD FOR EARTH-WORKING

The invention relates to a machine, in particular a construction machine, having a mast, along which a top drive can be moved vertically by means of an adjusting device, through which top drive a telescopic kelly bar is displaceably guided, the kelly bar having at least one outer kelly bar, which is designed to come to lie on the top drive, and an inner kelly bar, which comprises a rope suspension for a rope, through which the inner kelly bar can be moved vertically by means of a main rope winch.

The invention further relates to a method for earth-working with a machine, in particular a machine having a mast, along which a top drive can be moved vertically by means of an adjusting device, through which top drive a telescopic kelly bar is displaceably guided, which has at least one outer kelly bar, which is designed to come to lie on the top drive, and one inner kelly bar, which comprises a rope suspension for a rope, through which the inner kelly bar is moved vertically by means of a main rope winch, wherein the earth is worked with an earth-working tool attached to a lower end of the inner kelly bar.

A kelly bar is a telescopic bar tool which is constructed from a plurality of tubular rod elements and has at least one outer kelly bar and one inner kelly bar. The inner kelly bar and therefore the kelly bar as a whole is suspended on a rope, wherein the kelly bar is guided through annular rotary drive, also known as a top drive. By means of the kelly bar, a torque can be transmitted to an earth-working tool, in particular a drilling tool, which is attached to the lower end of the inner kelly bar. Greater drilling depths can also be reached through a corresponding telescopic extension of the individual kelly bar elements.

For torque transmission, the individual kelly bar elements have stop strips axially extending on their outer side and on their inner side, which serve for torque transmission. In addition, at certain axial positions, in particular at a start and finish area, locking recesses or locking elements are provided, through which the kelly bar elements can be axially fixed relative to each other. In this way it is possible, via the drill drive, for axial pressure forces to also be applied to the kelly bar and therefore to the earth-working tool. The outer kelly bar can also be axially fixedly connected to the drill drive.

In particular during non-continuous earth-working, for example when creating a bore with a drilling bucket, the drilling bucket must be repeatedly moved into the borehole and moved out of it again. Depending on the respective borehole depth, the kelly bar is repeatedly telescopically retracted and extended correspondingly. After the drilling bucket has been filled with removed earth material, it must be pulled from the borehole to be emptied. For this it is necessary to move the individual kelly bar elements into each other again and to lock them. In this moved-in position the kelly bar can then be pulled, together with the drilling bucket, out of the borehole and pivoted to an emptying position. Then, the drilling tool is moved into the borehole again, with renewed telescopic extension of the kelly bar, for a further drilling step.

The retraction and extension of a kelly bar correspondingly require time. Thereby, drilling rig drivers endeavour to move the kelly bar in and out as quickly as possible, in order to achieve rapid drilling progress. In the event of the kelly bar being moved too quickly, however, there is the risk that it may abruptly come into contact with the earth area or the top drive, which can lead to considerable material stresses and even to damage or destruction of the top drive.

It is the object of the invention to indicate a machine and a method for earth-working, which facilitate efficient and at the same time particularly material-conserving and equipment-conserving working.

The machine according to the invention is characterised in that an automatic control device is provided, which is designed to automatically control the adjusting device for the top drive and/or the main rope winch for the kelly bar so that the inner kelly bar can be moved relative to the top drive in some areas in a rapid travel mode at a first speed and in some areas in a conservative travel mode, in which the speed is reduced in comparison with the first speed of the rapid travel mode.

It is a core idea of the invention to automatically control the movement of the kelly bar elements by means of a control device, and to do this in such a way that rapid retraction or extension of the kelly bar elements in a rapid travel mode is realised in certain movement areas, whereas movement in a conservative travel mode at a reduced speed is realised in certain critical movement areas. The movement speed relates to the top drive, thus the rotary drive, or the mast. The speed is brought about according to the invention by a controller of the adjusting device of the top drive and/or alternatively by a controller of the main rope winch for the kelly bar. The adjusting device for the top drive can itself be a feed winch, a hydraulic actuator or another linear drive, for example a rack and pinion drive. The controller according to the invention allows a very rapid telescopic retraction and extension of the kelly bar, wherein a rapid movement is realised in non-critical areas, for example in a central area of the kelly bar elements. In critical areas, for example if a stop collar at the upper end of the outer kelly bar comes to lie on the top drive, or directly before the earth is reached by the earth-working tool attached to the lower end of the inner kelly bar, the controller switches from the rapid travel mode with a first high speed to a conservative travel mode, in which the speed is reduced. In the conservative travel mode, the speed can be gradually reduced to the value 0. In this way, material-damaging impacts, which may arise if the earth-working tool abruptly comes into contact with the earth or if the outer kelly bar abruptly comes into contact with the top drive, can be avoided. All in all, the invention allows the working efficiency to be increased and the risk of damage to the tool, the kelly bar and the drilling unit as a whole to be avoided.

In the simplest case, the kelly bar is composed of just two bar elements, namely a tubular outer kelly bar and an inner kelly bar arranged displaceably therein. In order to reach greater drilling depths it is advantageous according to a development of the invention that the kelly bar has one or a plurality of intermediate kelly bar elements, which are arranged between the outer kelly bar and the inner kelly bar. In particular, kelly bars with three or four bar elements are preferred.

In principle the machine according to the invention with the kelly bar can be used for widely varying activities. It is particularly useful according to a development of the invention that a drilling tool, in particular a drilling bucket or an auger, is detachably attached to the lower end of the inner kelly bar. Such drilling tools can be used for non-continuous drilling, in which a kelly bar must be repeatedly retracted and extended. The increase in the working speed achieved with the invention is particularly advantageous with these repeated processes.

According to a further preferred embodiment of the invention at least one input device is provided, with which a type and/or size of the kelly bar, a position of the adjusting device for the top drive, a position of the rope and/or a type and/or size of the top drive can be input. In the simplest case, manual input can be carried out using an input terminal. Furthermore it is possible to bring the respective components into a defined starting position and to calibrate the machine with these components.

According to a preferred development of the invention the input device has at least one sensor for automatic input. The type and/or size of the kelly bar can thus be reached through corresponding optical sensors for automatic detection or through a rope force measurement on the rope of the main rope winch. With respect to the type and/or size of the top drive, besides an input for the top drive, a range of spring measurement can also be realised on the spring damping elements, which are arranged on the upper side of the top drive. The position of the adjusting device for the top drive and the position of the rope of the main rope winch can be automatically determined by means of corresponding incremental encoders or other suitable position sensors. The control device can preferably save the input values determined in a data memory. This is useful for example if the kelly bar is extended and the earth-working tool is located in the borehole. After retraction of the bar and emptying of the tool, the kelly bar can be extended again into the previous position corresponding to the saved data.

In principle, a fixedly predefined program for the automatic controller can be provided. In a particularly useful variant of the invention, depending on the input via the input device, the areas, in which a movement according to the rapid travel mode or the conservative travel mode is provided, can be fixed via the control device upon adjustment of the kelly bar. The control device can be designed in particular as an adaptive controller which adapts start and finish time points for the rapid travel mode and respectively the conservative travel mode for each telescopic process. In particular the respective position of the top drive on the mast and also the current drilling depth can be considered for a particularly rapid extension and retraction of the kelly bar elements. For a particularly gentle movement of the kelly bar elements in the conservative travel mode, it is advantageous according to a development of the machine according to the invention that the rope can be moved via the main rope winch and the top drive moved via the adjusting device at the same time in the same direction in order to reduce the speed in the conservative travel mode. This allows in particular an abrupt impacting of the outer stop collar on the outer kelly bar onto the top drive to be particularly efficiently cushioned or prevented.

The method according to the invention is characterised in that the adjusting device for the top drive and/or the main rope winch for the kelly bar can be controlled automatically by means of a control device, wherein the inner kelly bar is moved relative to the top drive in some areas in a rapid travel mode at a first speed and in some areas in a conservative travel mode, in which the speed is reduced in comparison with the first speed of the rapid travel mode.

The method according to the invention can be carried out in particular with a machine, as has been previously described. Accordingly, the previously described advantages can be achieved.

The movement of the kelly bar is realised in principle via the main rope winch with a rope, which is fastened to the upper end of the inner kelly bar. It is provided according to one embodiment of the invention that the inner kelly bar is moved alone or together with other bar elements of the kelly bar. It is also possible for the outer kelly bar to be moved independently of the inner kelly bar by means of the top drive with the adjusting device.

In a further preferred method variant, a movement is carried out in the conservative travel mode directly before the kelly bar comes lie on the top drive, the earth-working tool comes into contact with the ground and/or at a transition, at which two bar elements of the kelly bar are moved into each other or moved out of each other. A movement of the kelly bar elements relative to each other in the conservative travel mode can also be realised in areas, at which two locking elements move past each other, without locking being provided. Damage to the locking elements, which are provided for axial fixing of the bar elements of the kelly bar, can thus be avoided.

In principle a movement of the individual kelly bar elements in the conservative travel mode can be provided at any desired position, provided that this is regarded as critical by the drilling rig driver. At all other positions, a rapid movement in the rapid travel mode can be carried out in order to telescopically extend or retract the kelly bar correspondingly rapidly. The areas in which and the times at which there is a switchover between a rapid travel mode and a conservative travel mode can be manually input in principle into the control device by means of an input device.

In a particularly advantageous variant of the invention, the control device determines, using input values, when a movement is realised in the rapid travel mode or a movement is realised in the conservative travel mode. In particular this can be realised depending on the borehole depth and the position of the top drive relative to the upper end of the kelly bar, so that adaptive control is realised.

It is particularly advantageous according to one development of the invention that the input values are automatically detected at least in part by the control device by means of an input device. For this, corresponding sensors or measurement value recorders are provided in order to automatically detect the desired input values and to forward them wired or wirelessly to the control device.

Figure 2:
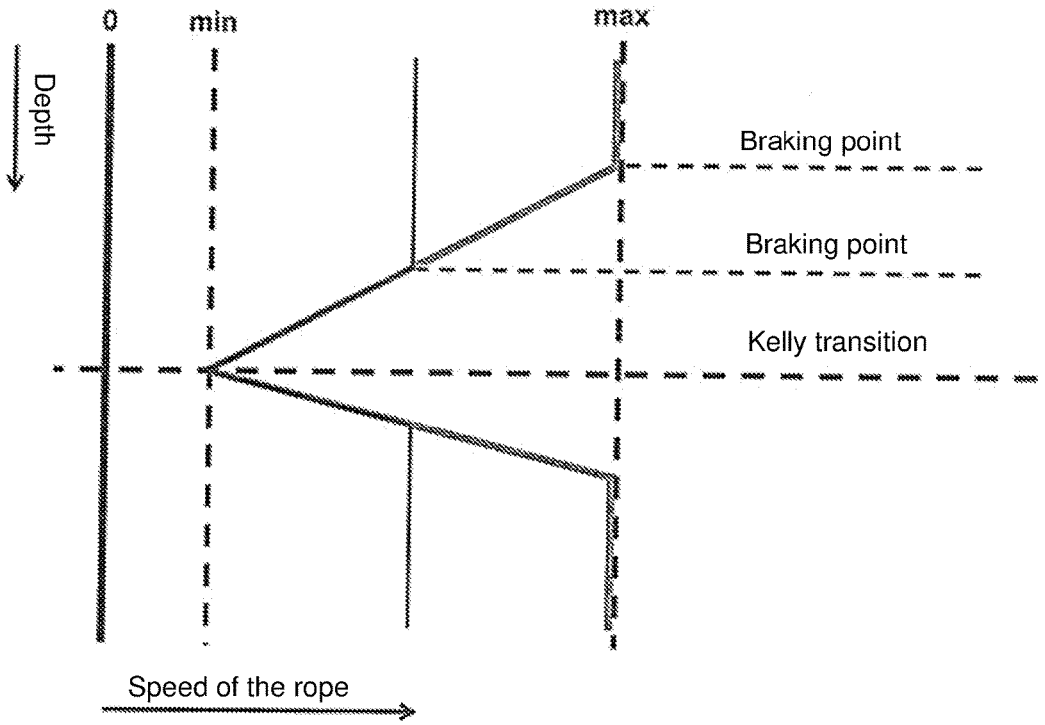

The invention will be further described by reference to preferred embodiments, which are shown schematically in the appended drawings, in which:

FIG. 1 shows a schematic side view of a machine according to the invention; and FIG. 2 shows a diagram of the speed pattern when a kelly bar element is lowered.

A machine 10 according to the invention, which is designed as a drilling unit, has according to FIG. 1 a carrier vehicle 12 with a crawler chassis and a rotatable upper structure. In the known way, a vertical mast 14 is pivotably attached to the carrier unit 12, along which mast a carriage 18 with a top drive 20 is mounted so that it can be moved. To move the carriage 18, a feed winch is arranged as an adjusting device 22 at the rear side of the mast 14. The adjusting device 22 is connected to the carriage 18 via a feed rope 24, which is guided via a mast head 16 of the mast 14.

A kelly bar 40 is guided through the annular top drive 20, the kelly bar being suspended on a rope 50 via a rope suspension 49. The rope 50 is guided via the mast head 16 to a rearward main rope winch 30.

The kelly bar 40 has an outer kelly bar 42 with an upper tube collar 44, which is designed with a larger diameter to come to lie on the top drive 20. By means of entrainment strips (not illustrated in greater detail), a torque of the top drive 20 can be transmitted to the outer kelly bar 42 and thus to the kelly bar 40. Within the tubular outer kelly bar 42 an inner kelly bar 46 is displaceably mounted, at the upper end of which the rope suspension 49 is attached. At the lower end of the inner kelly bar 46, a damping pot 48 is arranged, to which an earth-working tool 60 designed as a drilling bucket is attached in a rotationally fixed way.

According to the illustration of FIG. 1, the kelly bar 40 is telescopically retracted, wherein the inner kelly bar 46 has moved into the inner space of the tubular outer kelly bar 42. Telescopic retraction and extension of the kelly bar 40 are realised automatically by a schematically shown control device 70. The control device 70 can be operated by a machine driver by means of actuators 74, for example foot controls, joysticks or GUI. To create a borehole, the rope 50 is firstly lowered via the main rope winch 30 until the tube collar 44 on the outer kelly bar 42 lies on the upper side of the top drive 20.

Further lowering of the kelly bar 40 can be realised through a movement of the top drive 20 by means of the adjusting device 22, wherein the top drive 20 is moved downwards along the mast 14 by means of the carriage 18. The outer kelly bar 42 and the inner kelly bar 46 are moved simultaneously. The outer kelly bar 42 can be locked to the top drive 20 and thus axially fixed. Alternatively or subsequently, in the case of a stationary top drive 20, the rope 50 can be further lowered via the main rope winch 30, wherein the inner kelly bar 46 is moved out of the outer kelly bar 42. By means of corresponding incremental encoders and sensors the control device 70 receives values on the position of the top drive 20, the outer kelly bar 42 and the inner kelly bar 46. Furthermore the control device 70 can request data from a data memory 72, for example on the size and length of the kelly bar 40, the dimensions of the earth-working tool 60 or the top drive 20. Depending on these data, the movement of the kelly bar 40, and in particular the inner kelly bar 46, is automatically controlled. In principle, a movement of the kelly bar elements is provided in a rapid travel mode at a high first speed. In certain movement areas, for example directly before the tube collar 44 comes to lie on the top drive 20, or the earth-working tool 60 comes into contact with the ground, or at the transition of two kelly bar elements, the control device 70 switches from the rapid travel mode to a conservative travel mode, in which the speed is reduced. The speed reduction can be carried out abruptly to a low, second speed value or preferably gradually to a reduced speed or as far as 0.

A possible speed pattern of the rope 50 with respect to borehole depth is shown schematically in FIG. 2. From a maximum rope speed in the rapid travel mode, before a critical movement area, for example at a kelly transition, a switchover to a conservative travel mode is initiated by the control device 70 at a braking point 1. In the conservative travel mode the rope speed is gradually reduced from a first maximum value to a second minimum value. If the critical area is passed, for example a passing of locking recesses arranged along the kelly bar elements and in particular at the start and end thereof, there can be a switchover back to the rapid travel mode by the control device 70. The rope speed of the rope 50 is increased again to the first speed value in the rapid travel mode.

The control device 70 can be adaptively designed as a learning system, wherein for example the braking point is changed from a first braking point 1 to a second, later braking point 2, in order to keep the movement times short.

The invention claimed is:

1. A machine comprising a mast, along which a top drive can be moved vertically by means of an adjusting device, through which top drive a telescopic kelly bar is displaceably guided, which has at least one outer kelly bar which is designed to come to lie on the top drive, and one inner kelly bar which comprises a rope suspension for a rope, through which the inner kelly bar can be moved vertically by means of a main rope winch, wherein an automatic control device is provided, which is designed to automatically control the adjusting device for the top drive and/or the main rope winch for the kelly bar in such a way that the inner kelly bar can be moved relative to the top drive in some areas in a rapid travel mode at a first speed and in some areas in a conservative travel mode, in which the speed is reduced with respect to the first speed of the rapid travel mode, the automatic control device provides movement according to the rapid travel mode or the conservative travel mode before or after a drilling operation, and the movement in the conservative travel mode is realized at a transition, at which the inner kelly bar is moved inside the outer kelly bar, wherein the outer kelly bar has a first locking element, the inner kelly bar has a second locking element, and in the conservative travel mode, the first locking element is configured to move past the second locking element without locking being provided.

2. The machine according to claim 1, wherein the kelly bar has one or more intermediate kelly bar elements, which are arranged between the outer kelly bar and the inner kelly bar.

3. The machine according to claim 1, wherein an earth-working tool, in particular a drilling bucket or an auger, is detachably attached to a lower end of the inner kelly bar.

4. The machine according to claim 1, wherein at least one input device is provided, with which a type and/or size of the kelly bar, a position of the adjusting device for the top drive, a position of the rope and/or a type and/or size of the top drive can be input.

5. The machine according to claim 4, wherein the input device has at least one sensor for automatic input.

6. The machine according to claim 4, wherein depending on the input via the input device, the areas in which the movement is provided according to the rapid travel mode or the conservative travel mode are fixed by the control device upon movement of the kelly bar.

7. The machine according to claim 1, wherein to reduce the speed in the conservative travel mode, the rope can be moved via the main rope winch and the top drive via the adjusting device at the same time in the same direction.

8. A method for earth-working with a machine having a mast, along which a top drive can be moved vertically by means of an adjusting device, through which top drive a telescopic kelly bar is displaceably guided, which has at least one outer kelly bar, which is designed to come to lie on the top drive, and one inner kelly bar, which comprises a rope suspension for a rope, through which the inner kelly bar is moved vertically by means of a main rope winch, wherein the earth is worked with an earth-working tool, which is attached to a lower end of the inner kelly bar, the method comprising:

automatically controlling the adjusting device for the top drive and/or the main rope winch for the kelly bar by means of a control device, wherein the inner kelly bar is moved relative to the top drive in some areas in a rapid travel mode at a first speed and in some areas in a conservative travel mode, in which the speed is reduced in comparison with the first speed of the rapid travel mode, providing movement with the control device according to the rapid travel mode or the conservative travel mode before or after a drilling operation, and realizing the movement in the conservative travel mode at a transition, at which the inner kelly bar is moved inside the outer kelly bar, wherein the outer kelly bar has a first locking element, the inner kelly bar has a second locking element, and in the conservative travel mode, the first locking element is configured to move past the second locking element without locking being provided.

9. The method according to claim 8, comprising:

moving the inner kelly bar alone or together with other bar elements of the kelly bar.

10. The method according to claim 8, comprising:

realizing the movement in the conservative travel mode directly before the kelly bar comes to lie on the top drive, and/or before the earth-working tool comes into contact with the ground.

11. The method according to claim 8, wherein the control device determines, using input values, when the movement in the rapid travel mode or the movement in the conservative travel mode is realized.

12. The method according to claim 11, wherein the input values are automatically detected at least in part by the control device by means of an input device.

13. The machine according to claim 1, wherein the automatic control device provides the movement according to the conservative travel mode before a portion of the top drive makes contact with an upper end of the kelly bar, or the automatic control device provides the movement according to the conservative travel mode before the earth is reached by an earth-working tool attached to a lower end of the kelly bar.

14. The method according to claim 11, wherein the control device provides the movement according to the conservative travel mode before a portion of the top drive makes contact with an upper end of the kelly bar, or the control device provides the movement according to the conservative travel mode before the earth is reached by an earth-working tool attached to a lower end of the kelly bar.

* * * * *